United States Patent [19]

Lonardi

[11] Patent Number: 4,878,797

[45] Date of Patent: Nov. 7, 1989

[54] METHOD AND APPARATUS FOR CORRECTING THE FALLING PATH IN A LOADING INSTALLATION OF A SHAFT FURNACE

[75] Inventor: Emile Lonardi, L-Bascharage, Luxembourg

[73] Assignee: Paul Wurth S.A., Luxembourg

[21] Appl. No.: 168,926

[22] Filed: Mar. 16, 1988

[30] Foreign Application Priority Data

Mar. 24, 1987 [LU] Luxembourg ..... 86.822

[51] Int. Cl.[4] ..... F23K 3/00

[52] U.S. Cl. ..... 414/161; 110/108; 414/199; 414/786

[58] Field of Search ..... 414/148, 150, 160, 161, 414/199–208, 786, 289; 222/185; 432/239, 245; 110/108, 256, 293

[56] References Cited

U.S. PATENT DOCUMENTS

| | | | |
|---|---|---|---|
| 1,171,414 | 2/1916 | Carpenter et al. | 414/148 |
| 2,684,897 | 7/1954 | Diettrich | 414/161 X |
| 4,368,813 | 1/1983 | Mailliet | 414/160 X |
| 4,547,116 | 10/1985 | Legille et al. | 414/207 X |
| 4,575,790 | 3/1986 | Legille et al. | 414/208 X |
| 4,714,396 | 12/1987 | Bernard et al. | 414/161 |

FOREIGN PATENT DOCUMENTS

| | | | |
|---|---|---|---|
| 789110 | 1/1958 | United Kingdom | 222/185 |

*Primary Examiner*—David A. Bucci

*Attorney, Agent, or Firm*—Fishman, Dionne & Cantor

[57] ABSTRACT

The process is intended to compensate for the random movements and inclinations of a loading installation of a shaft furnace having a storage lock chamber which is carried by a framework independent of the shaft furnace and which is connected to the shaft furnace by use of a compensator. In accordance with this process, the lateral shifts of the head of the furnace in relation to the lock chamber are detected, and the storage lock chamber is inclined until the axis of the falling path of the charge material corresponds to the shifted central axis (0′) of the furnace.

9 Claims, 3 Drawing Sheets

METHOD AND APPARATUS FOR CORRECTING THE FALLING PATH IN A LOADING INSTALLATION OF A SHAFT FURNACE

BACKGROUND OF THE INVENTION

This invention relates to a process and apparatus for correcting the falling path of charge material in a loading installation for a shaft furnace. More particularly, this invention relates to a process and apparatus for compensating the random movements and inclinations of the path of falling charge material in a loading installation of a shaft furnace, comprising a storage lock chamber which is carried by a framework independent of the furnace; and which is connected to the furnace by means of a compensator. The present invention is particularly well suited for use in an installation of the central-loading type such as is disclosed in No. EP-B1-0,062,770, corresponding to U.S. Pat. No. 4,514,129, assigned to the assignee hereof, all of the contents of which are incorporated herein by reference. This prior installation comprises a stand-by hopper and a storage lock chamber, both of which are aligned on the central axis above the furnace. It is well known that, in the course of time, a blast furnace can become slightly inclined relative to its initial position under the effect of thermal expansion or local compression caused by the load. This causes the central axis of the falling path of the loading material falling from the storage lock chamber to no longer correspond to the axis of the furnace because the lock chamber does not undergo the movements of the furnace as it is supported by an independent framework. These relative movements between the furnace and the lock chamber are made possible by the compensator between the furnace head and the valve housing located under the lock chamber.

Although this offset of the furnace head in relation to its initial or reference position is very slight, it is nevertheless sufficient to cause an off-center distribution of the loading material. Moreover, because the effects are cumulative for the successive layers and because a distribution chute (e.g. oscillating spout) is concerned, the effect of the offset is twofold since it is negative on one side and positive on the other side.

SUMMARY OF THE INVENTION

The above-discussed and other drawbacks and deficiencies of the prior art are overcome or alleviated by the process and apparatus of the present invention for correcting the falling path of charge material so that this path corresponds to the central axis of the furnace despite random movements and inclinations of the furnace. In accordance with the process of the present invention, in a first step, lateral shifts of the head of the furnace in relation to the lock chamber are detected. In a second step, the storage lock chamber is inclined until the axis of the falling path of the loading material corresponds to the central axis of the furnace. The storage lock chamber is preferably inclined by raising that side of the chamber in which the central axis of the furnace deviated from the initial central axis of reference, and by lowering the chamber on the opposite side thereof.

The present invention also provides an apparatus for carrying out the correction process described above in an installation in which the lock chamber is supported by means of several balances. This apparatus includes means for raising or lowering each balance and a ring of detectors independent of the furnace. The detectors are arranged around the lower part of the compensator in order to determine the direction and extent of the deviation of the furnace head relative to the initial reference axis.

The support means preferably comprises a threaded rod supporting a balance, the threaded rod being vertically shiftable via a casing; and the axial thread of a pinion seated in this casing by way of a bearing and rotated by means of an endless screw under the action of a motor. The threaded rod is associated with means preventing it from rotating, but allowing it to shift vertically. The motor causing the vertical movement of the threaded rod can be actuated manually or automatically under the control of the detectors detecting the offset of the furnace.

The storage lock chamber can be carried by the balances or can be suspended on the balances.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several Figures.

DESCRIPTION OF THE PREFERRED EMOBIDMENT

Figure 1:
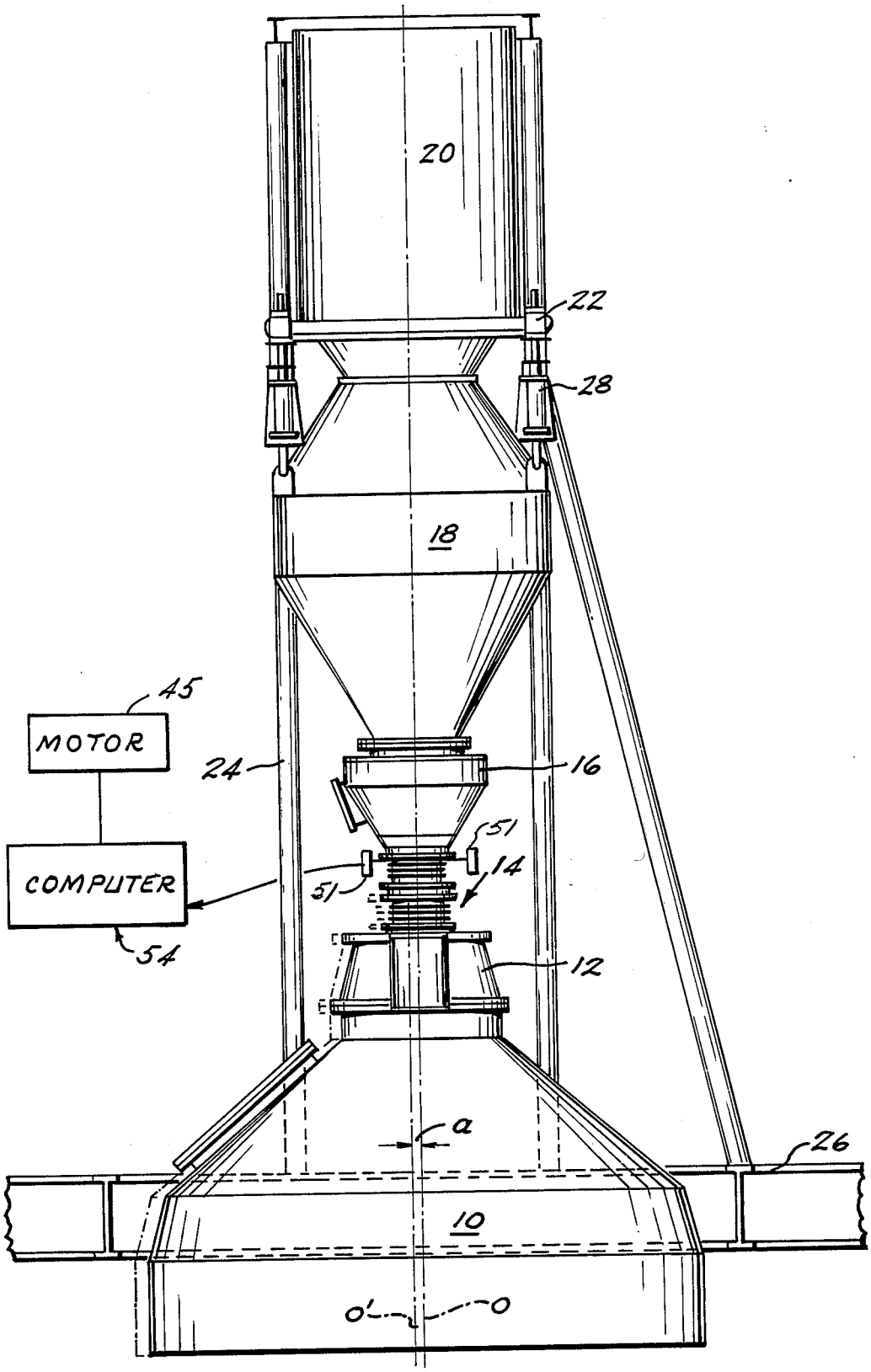
FIG. 1 is a diagrammatic side elevation view of a loading installation of a shaft furnace which is inclined slightly relative to its initial position.

Referring first to FIG. 1, the head of a shaft furnace is shown generally at 10 in which is located a device for distributing the loading or charging material (not shown), but which preferably consists of a rotary or oscillating distribution chute (such as is shown in abovementioned U.S. Pat. No. 4,514,129). This chute is activated by means of a known driving mechanism represented diagrammatically by the reference numeral 12. Arranged above furnace 10 and aligned on the central axis 0 of the furnace, are a corrugated compensator 14, a valve housing 16, a storage lock chamber 18 and a stand-by hopper 20. Everything which is above compensator 14 is supported by a framework consisting primarily of a horizontal supporting reinforcement 22 carried by several vertical pillars. In turn, the pillars are supported by a structure, which is independent of furnace 10 (for example the known square tower which is usually arranged around a shaft furnace).

As explained in the Background section, the shaft furnace will move over the course of time so that eventually, its central axis 0 will shift into the position represented by 0', the new position of the furnace 10 being represented by dot-and dash lines on the left-hand side of the Figure. The offset "a" illustrating the extent of the shift of the furnace axis has been exaggerated in relation to the general dimensions of the installation for explanatory purposes. This offset "a" continues up to the region of compensator 14 which specifically allows for the transition between the axis 0′ and the initial reference axis 0.

Figure 2:
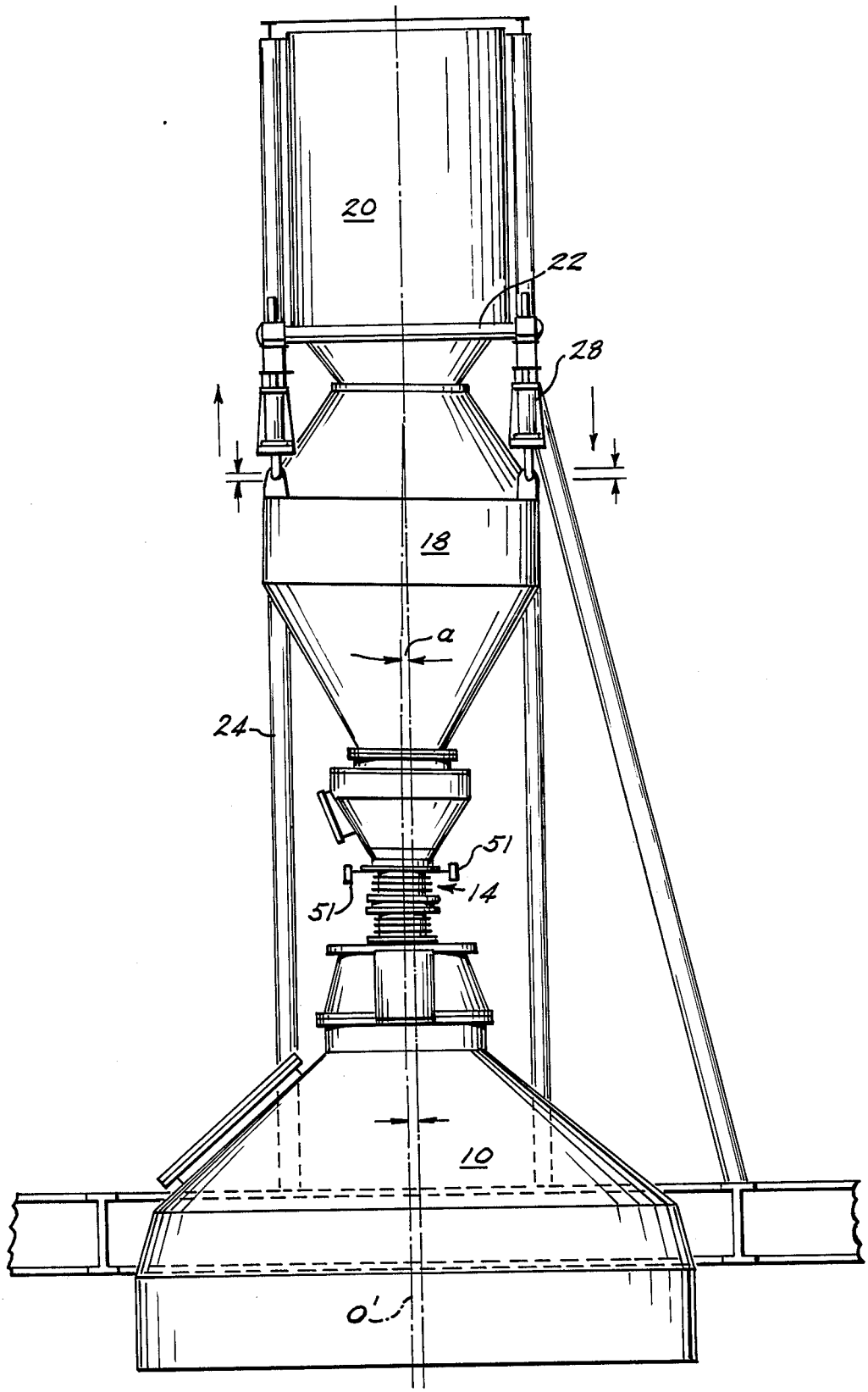
FIG. 2 is a diagrammatic side elevation view showing the process for correcting the falling path in the installation of FIG. 1.

To ensure central loading in the true axis 0′ of furnace 10 despite this offset lock chamber 18 is inclined on the opposite side relative to the offset "a" in relation to the initial axis 0. For this purpose, lock chamber 18 is raised slightly on the left hand side in FIG. 2 and lowered slightly on the opposite side. As a result, lock chamber 18 will be inclined at an angle $\alpha$ relative to its initial position, until the center of its outflow orifice is in the extension of the true axis 0′ of furnace 10.

Figure 3:
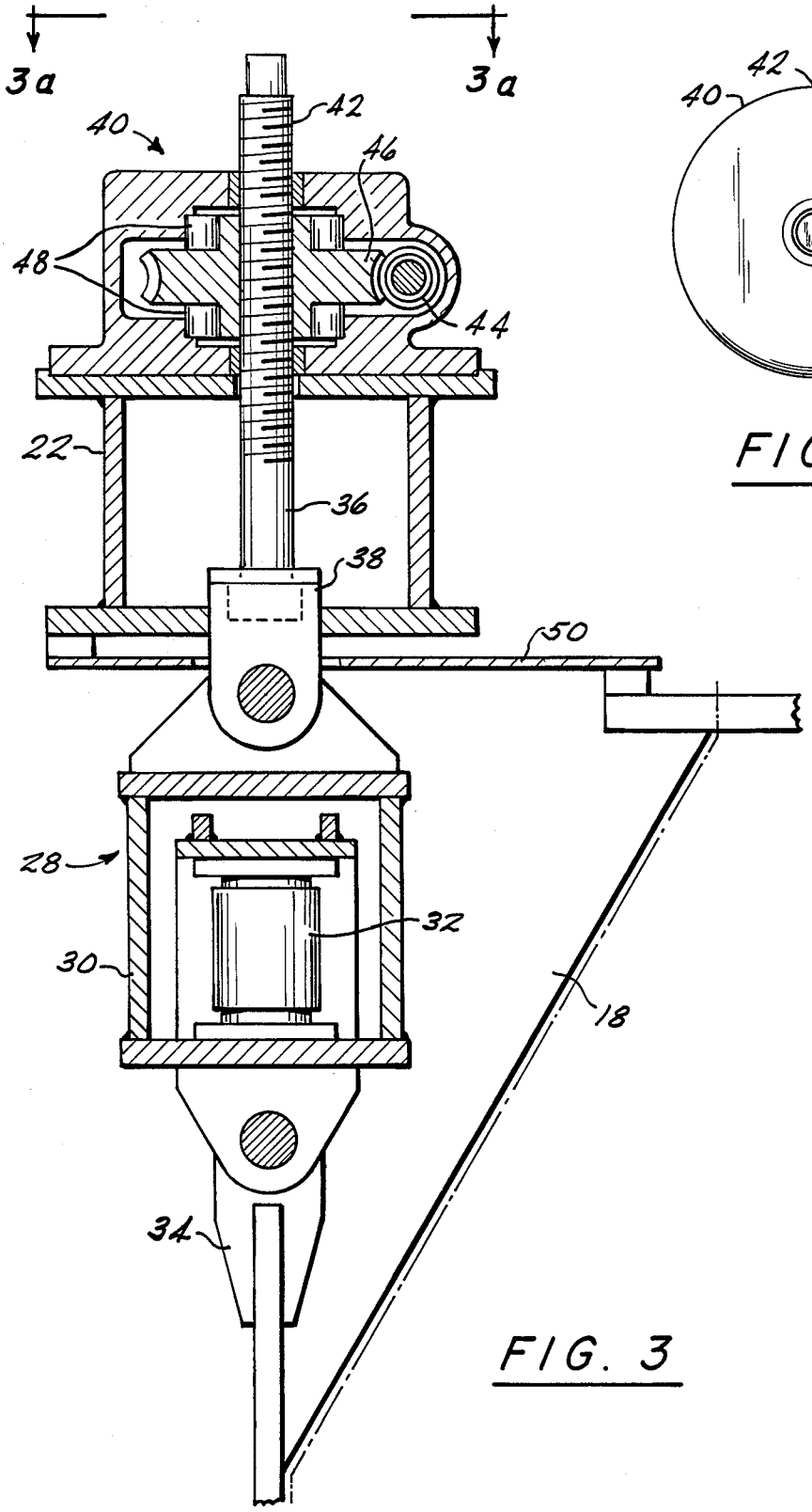
FIG. 3 is a cross-sectional elevation view showing the details of an apparatus for permitting the inclination of the storage lock chamber to change.
Figure 3A:
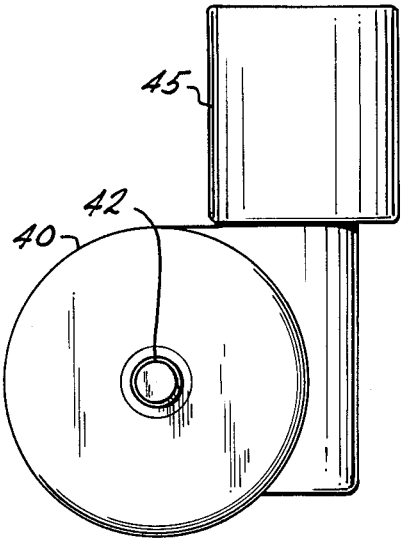
FIG. 3*a* is a plan view along the line 3*a*—3*a* of FIG. 3.

In FIG. 3, a preferred embodiment of an apparatus in accordance with the present invention for allowing the storage lock chamber 18 to incline is shown. Storage lock chamber 18 is suspended on reinforcement 22 by means of several, preferably four, balances. FIG. 3 illustrates diagrammatically the upper part of lock chamber 18 which is suspended on one of the balances 28. This balance can comprise, for example, a cage 30 containing a stress cell 32 (for example, a piezo-electric transducer). A yoke 34 welded to the outer wall of lock chamber 18 passes through the bottom of cage 30 and rests on the head of cell 32. It will be appreciated that instead of a cell 32 being used to measure weight by means of a compression effect, it is also possible, to provide a cell which measures tensile stress.

Balance 28 is suspended on the lower end of a rod 36 which passes through reinforcement 22. The lower part 38 of rod 36 and the passage orifice in reinforcement 22 for part 38 have Polygonal cross-sections to both prevent rod 36 from rotating about its longitudinal axis, as well as to allow rod 36 to slide vertically.

A casing 40 is provided on reinforcement 22 through which passes the upper part of rod 36 having an external thread 42. Inside casing 40 is a reduction unit actuating rod 36 in the vertical direction. In the illustrated example, this reduction unit is composed of an endless-screw gear comprising a screw 44 acting on the ring of a pinion 46 seated inside housing 40 by way of bearings 48. Pinion 46 has an axial passage equipped with a thread which is engaged with threaded part 42 of rod 36. The arrangement is therefore such, that as a result of the rotation of pinion 46, a rotation of endless screw 44 causes rod 36 to be raised or lowered depending on the direction of rotation of screw 44. Screw 44 can be driven by means of an electric motor 45.

A flexible strip connecting the upper part of lock chamber 18 to the reinforcement 22 is identified at 50. Strip 50 ensures the horizontal and slewing stability of lock chamber 18, while at the same time preserving its freedom of vertical movement to allow weighing by means of balances 28.

To ascertain the extent to which it is necessary to raise or lower rod 36 in order to incline the axis of lock chamber 18 to reestablish central falling, a series of detectors 51 is advantageously arranged around the lower part of compensator 14. In this particular case, detectors 51 can be distance detectors which are known per se, and which are mounted independently of the furnace so as not to undergo the movements of the latter. These detectors 51 make it possible to measure movement of compensator 14 towards or away from them and thus provide an indication as to the extent of the offset "a". Of course, that detector which supplies the largest measuring signal represents the orientation of the offset "a". When these measurements are known, it is possible to manually actuate each of the motors acting on the endless screws 44, until the axis of lock chamber 18 is inclined at an angle a relative to the vertical axis.

The operation of inclining the lock chamber can be controlled, that is, the moment when the desired inclination is reached can be determined in various ways. It is possible, for example, to mount the detectors intended for making the extent and orientation of the offset "a" on a circular support integral with the fixed upper collar of compensator 14. This means that the inclination of lock chamber 18 causes a horizontal offset of the support of the detectors and consequently of the detectors themselves. The operation of inclining lock chamber 18 can therefore be controlled manually, until compensator 14 is Perfectly cylindrical once again, in other words, until the measuring signals supplied by the detectors have disappeared.

It will be appreciated that the signals representing the offset a may be used to calculate the angle of inclination $\alpha$ of the lock chamber necessary for compensating this offset and to automatically actuate (under the control of a computer 54), the motors which make it possible to carry out the inclination.

The above description refers to a lock chamber which is suspended on reinforcement 22 by means of balances. However, it is also possible to use the present invention on a carried lock chamber, that is a lock chamber resting on reinforcement 22 by means of balances. In this case, the balances are carried by the upper ends of rods 36.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Process for correcting the falling path of charge material in a loading installation of a shaft furnace in order to compensate for the random movements and inclinations of the shaft furnace whereby the central axis of the shaft furnace deviates from an initial reference axis 0, the loading installation comprising a storage lock chamber which is carried by a framework independent of the shaft furnace and which is connected to the head of the shaft furnace by compensator means, including the steps of:

detecting lateral shifting of the head of the shaft furnace in relation to the storage lock chamber to determine the shifted central axis 0′of the shaft furnace; and inclining the storage lock chamber until the axis of the falling path of the charge material corresponds to said shifted central axis 0′of the shaft furnace.

2. Process according to claim 1 wherein the step of inclining the storage lock chamber comprises:

raising the storage lock chamber on the side in which the central axis of the furnace deviates from the initial reference axis 0; and lowering the storage lock chamber on the opposite side from which it is being raised.

3. Apparatus for correcting the falling path of charge material in a loading installation of a shaft furnace in order to compensate for the random movements and inclinations of the shaft furnace whereby the central axis of the shaft furnace deviates from an initial reference axis 0 comprising:

a storage lock chamber supported on a framework, said framework being independent of the shaft furnace;

compensator means connecting said storage lock chamber to the head of the shaft furnace;

detector means for detecting lateral shifting of the head of the shaft furnace in relation to said lock chamber to determine the shifted central axis 0'of the furnace; and inclining means for inclining said storage lock chamber until the axis of the falling path of charge material corresponds to said shifted central axis 0'of the shaft furnace.

4. Apparatus according to claim 3 wherein said inclining means comprises a plurality of balance means supporting said storage lock chamber and including:

means for raising or lowering each of said balance means; and a plurality of said detector means being independent of the shaft furnace and being arranged around the lower part of the compensator means, said detector means determining the direction and extent of the deviation of the head of the shaft furnace in relation to the initial reference axis 0.

5. Apparatus according to claim 4 wherein said means for raising or lowering each of said balance means comprises:

a threaded rod supporting a balance and being vertically shiftable via a casing; and an axial thread of a pinion seated in said casing by a bearing, said threaded rod being rotated by means of an endless screw actuated by motor means; and means preventing said rod from rotating but allowing it to move vertically.

6. Apparatus according to claim 4 wherein:

said detector means are mounted on a circular support integral with a fixed upper collar of the compensator means.

7. Apparatus according to claim 5 wherein:

said motor means is controlled automatically by means of a computer as a function of the signals supplied by said detector means.

8. Apparatus according to claim 4 wherein:

said lock chamber is suspended on said balance means.

9. Apparatus according to claim 4 wherein:

said lock chamber is carried by said balance means.

* * * * *